US005102059A

United States Patent [19]

Nyberg et al.

[11] Patent Number: 5,102,059

[45] Date of Patent: Apr. 7, 1992

[54] DISINTERGRATING APPARATUS

[75] Inventors: Jan-Erik Nyberg, Söderhamn; Holger Svensson, Sandarne, both of Sweden

[73] Assignee: AB Sandarne Industrimaskiner, Sandarne, Sweden

[21] Appl. No.: 629,458

[22] Filed: Dec. 18, 1990

Related U.S. Application Data

[63] Continuation-in-part of Ser. No. 375,016, Aug. 7, 1989, abandoned.

[51] Int. Cl.[5] ..... B02C 13/26

[52] U.S. Cl. ..... 241/243; 241/277

[58] Field of Search ..... 241/166, 167, 242, 239, 241/243, 241, 285 R, 285 A, 285 B

[56] References Cited

U.S. PATENT DOCUMENTS

| | | | |
|---|---|---|---|
| 2,149,289 | 3/1939 | Hall | 241/285 B |
| 4,009,836 | 3/1977 | Strom et al. | 241/285 B |
| 4,023,444 | 2/1978 | Pav | 241/243 B X |
| 4,049,206 | 9/1978 | Konig et al. | 241/285 B X |
| 4,077,573 | 3/1978 | Kersey et al. | 241/243 X |
| 4,385,732 | 5/1983 | Williams | 241/243 X |
| 4,394,983 | 7/1983 | Ulsky | 241/243 |
| 4,690,337 | 9/1987 | Sti et al. | 241/167 X |
| 4,724,662 | 2/1988 | Glandenate et al. | 241/243 X |

FOREIGN PATENT DOCUMENTS

| | | | |
|---|---|---|---|
| 2544496 | 4/1977 | Fed. Rep. of Germany | 241/285 B |
| 2632330 | 1/1978 | Fed. Rep. of Germany | 241/285 B |

*Primary Examiner*—Timothy V. Eley

*Attorney, Agent, or Firm*—McFadden, Fincham, Marcus & Anissimoff

[57] ABSTRACT

A disintegrating apparatus comprising a material infeed hopper and a rotatable shaft mounted in an elongate opening in a frame disposed under the hopper. The shaft comprises a plurality of helically arranged and axially spaced apart working means which cooperate with holding-up means in the area of a front longitudinal side edge of the opening. The hopper is hingedly connected to the frame so that, if necessary, the hopper can be swung up to give access to the shaft. In addition to said holding-up means, the apparatus comprises a second set of holding-up means mounted at the rear longitudinal side edge of the opening and adapted to prevent large objects from passing down the back way between the shaft and the rear longitudinal side edge and to cooperate with the working means upon reversal of the direction of shaft rotation, so as to provide at least a certain degree of disintegration of material also in reversed operation.

9 Claims, 4 Drawing Sheets

DISINTERGRATING APPARATUS

This application is a continuation-in-part of application Ser. No. 07/375016, filed Aug. 7, 1989 now abandoned.

TECHNICAL FIELD OF THE INVENTION

The invention relates to a disintegrating apparatus comprising an infeed hopper adapted to receive material for disintegration, and a rotatable shaft which is mounted in an elongate opening in a frame or stand disposed under said hopper and which comprises a plurality of axially spaced-apart working means, e.g. knives or beaters, which are preferably helically arranged along the circumference of the shaft and which cooperate with holding-up means in the area of a front longitudinal side edge of said opening, said infeed hopper being hingedly connected to said frame so that, if necessary, the hopper can be swung up to give access to the shaft.

PRIOR ART TECHNIQUE

A disintegrating apparatus having a fixed infeed hopper but otherwise designed as described above, is known from SE patent specification 7606019-3. An essential advantage of this prior art apparatus is its ability to crush or disintegrate also very large and solid objects, such as logs, clumps of concrete, pieces of steel, etc. The apparatus is therefore especially suited for chipping or disintegrating demolition timber to be used as fuel. In actual practice, it is however an annoying disadvantage that some kinds of objects may pass down the back way between the shaft and the rear longitudinal side edge of the shaft opening without being worked by the knives or beaters of the shaft. This means on the one hand that unworked objects which are considerably larger than the maximum fraction size allowed, may be carried along by the accept material and, on the other hand, that such relatively large objects may be wedged between the shaft and an underlying bottom wall, and consequently, interfere with the operation of the apparatus. This phenomenon is particularly annoying when the direction of rotation of the shaft is reversed after such wedging has occurred in normal operation since, in reversed operation, the actual working means will actively strive to carry the material collected in the hopper towards the rear longitudinal side edge of the shaft opening. A further disadvantage of the prior art apparatus is that complicated and time-consuming measures are required in connection with service, e.g. upon exchange of the working means and holding-up means. In case of serious jamming, for example if a heavy steel girder or the like has got stuck between the working means and the holding-up means, the apparatus will be practically inoperable.

BRIEF DESCRIPTION OF THE INVENTIVE IDEA

The present invention aims at eliminating the above-mentioned disadvantages and providing a disintegrating apparatus which in a reliable manner produces a uniformly-worked accept material of a given maximum fraction size and which is easily serviced. According to the invention, these and other objects are achieved in that the apparatus comprises, in addition to said holding-up means, a second set of holding-up means mounted at the rear longitudinal side edge of the shaft opening and adapted to prevent large objects from passing down the back way between the shaft and the rear longitudinal side edge of the opening and to cooperate with said working means upon reversal of the direction of shaft rotation, so as to provide at least a certain degree of disintegration of material also in reversed operation.

According to a particular embodiment of the inventive apparatus, the shaft is divided into at least three parts, viz. a central part comprising said working means, and two end parts engaging with bearings which are mounted in the frame in the area outside the short ends of the shaft opening, the central part of the shaft being dismountable without necessitating simultaneous dismounting of said bearings and end parts, respectively.

FURTHER ELUCIDATION OF THE PRIOR ART TECHNIQUE

SE patent specification 8001602-5 discloses a disintegrating apparatus in which the infeed hopper is hingedly connected to the associated frame so that, if necessary, the hopper can be swung up to uncover two cooperating shafts which are provided with working means in the form of knives or cutting edges. However, the frame of this apparatus comprises no holding-up means or counter-blades, but the working means mesh in the area where the two parallel shafts touch each other.

BRIEF DESCRIPTION OF THE ACCOMPANYING DRAWINGS

DETAILED DESCRIPTION OF A PREFERRED EMBODIMENT OF THE INVENTION

Figure 1:
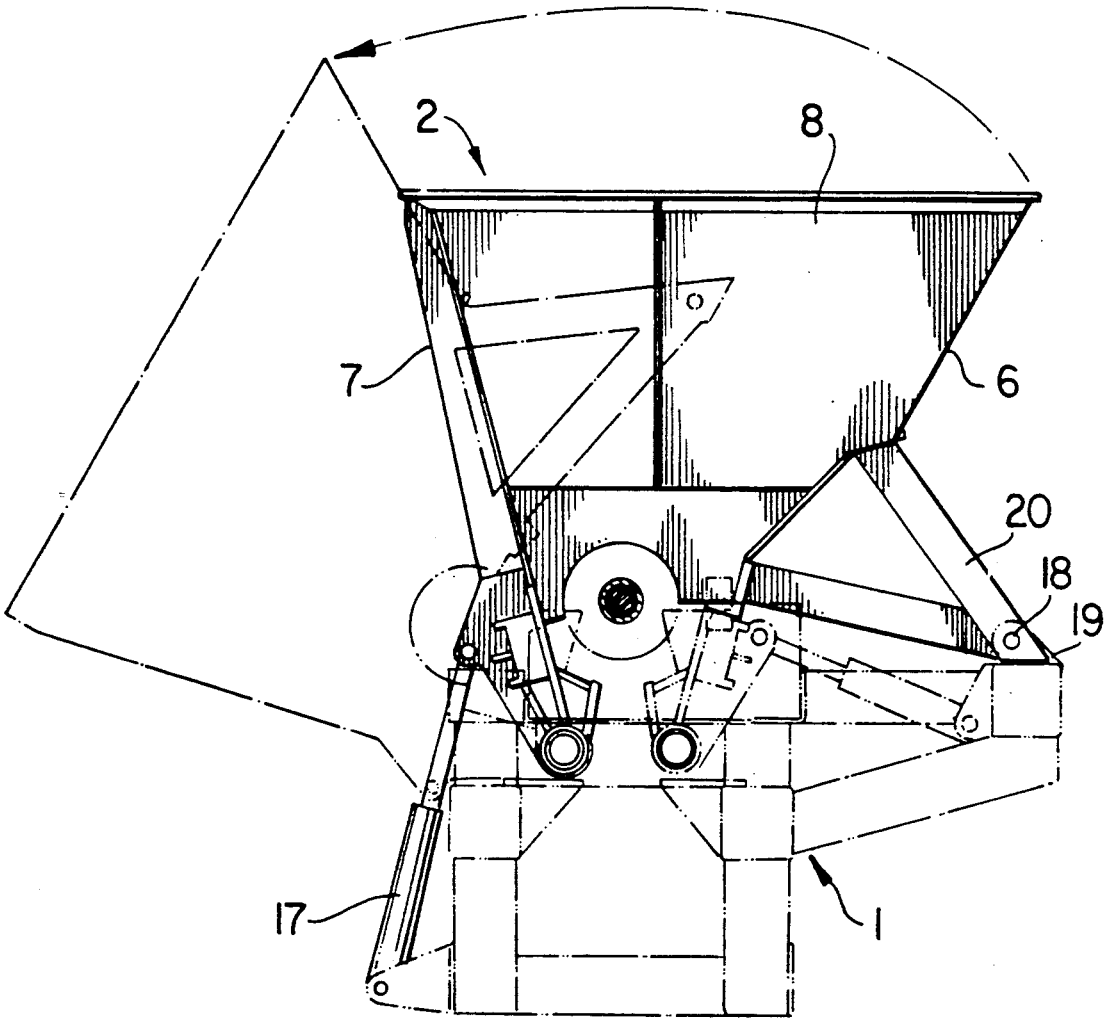
FIG. 1 is a simplified end view of the inventive apparatus.
Figure 2:
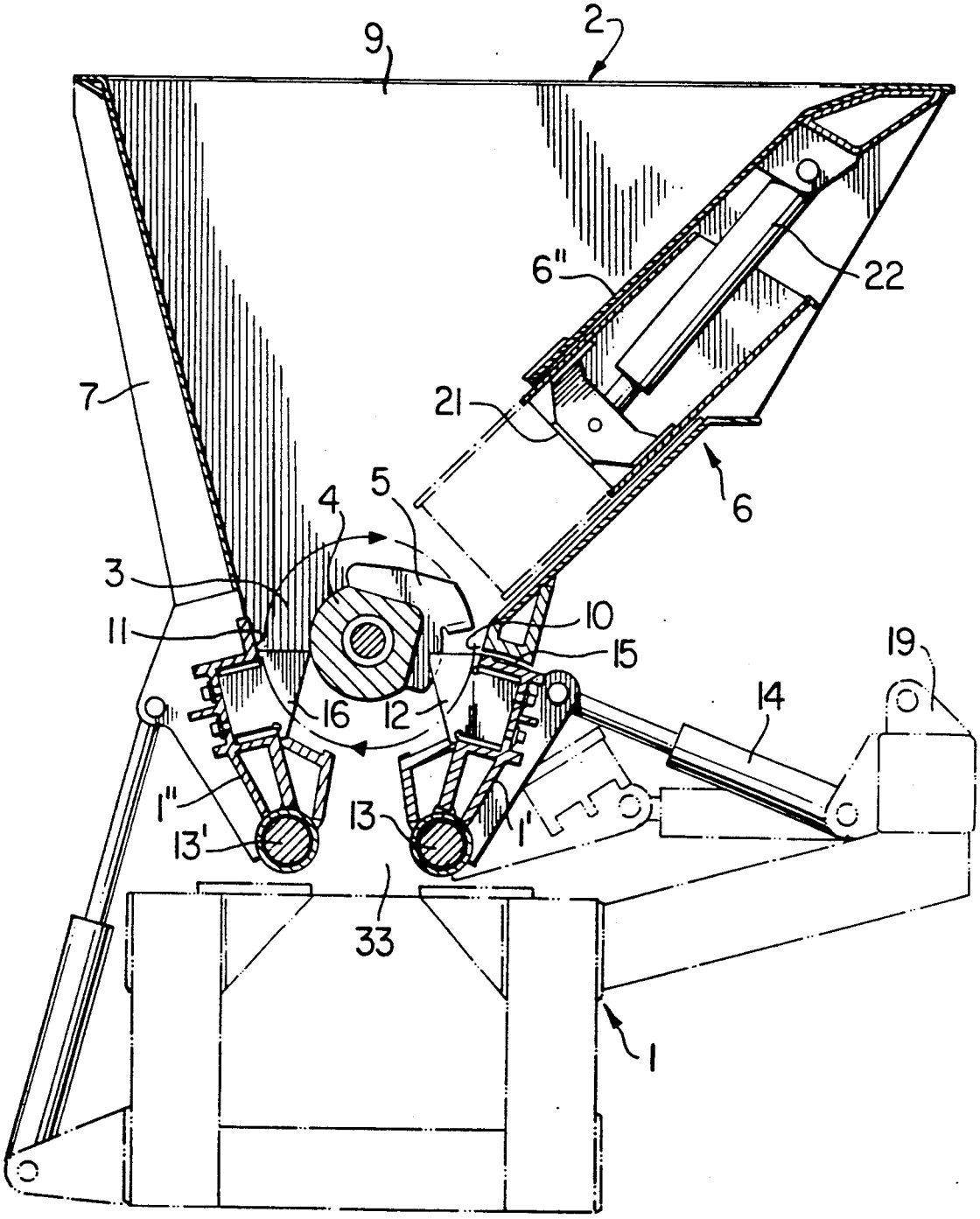
FIG. 2 is an enlarged section of the same apparatus, some components being omitted.
Figure 3:
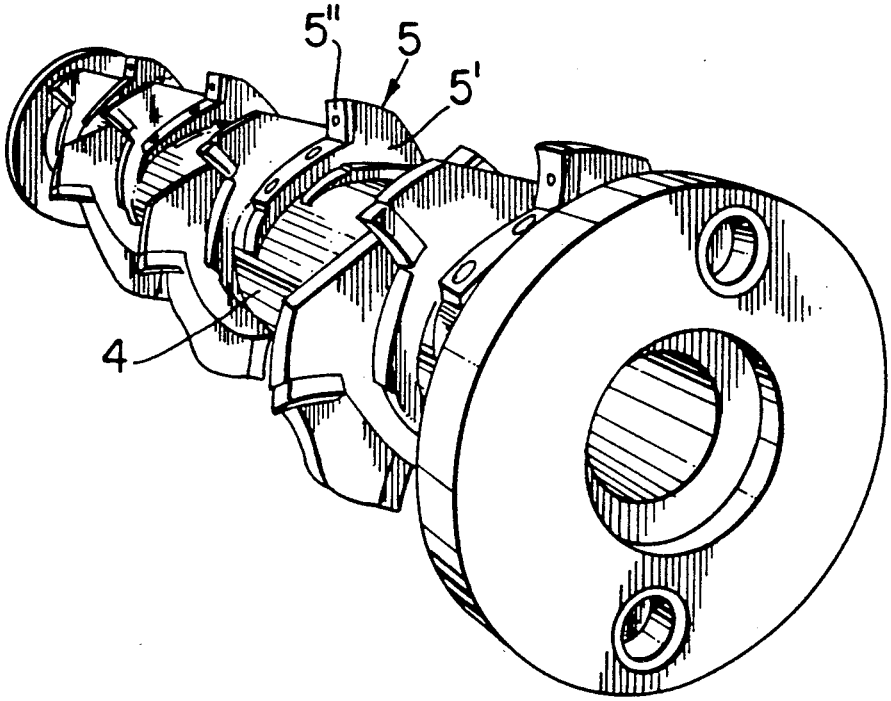
FIG. 3 is a perspective view of a central part of the working shaft.

In FIGS. 1 and 2, a frame or stand is generally designated 1 and may in practice preferably be mounted on a mobile unit, e.g. a wheel-mounted vehicle, but can also be stationary, and an infeed hopper in the form of a pocket is designated 2. In an elongate opening 3 in the area of the bottom of the hopper 2, there is mounted a rotatable shaft 4 comprising a plurality of axially spaced-apart working means 5. As shown in FIG. 3, the working means are preferably helically distributed along the circumference of the shaft so as not to engage all at once with the material or objects to be disintegrated, but instead one by one. As is further shown in FIG. 3, the working means may preferably be crescent-shaped jaws 5' which are detachably connected to the shaft, e.g. via bolt joints, and which comprise cutting tools 5'' which in turn are detachably mounted on the jaws.

In practice, the hopper 2 may have a length or axial extension which is at least twice the width of the hopper, said hopper comprising two longitudinal side walls 6,7 and two end walls 8,9, of which at least the longitudinal side walls 6,7 preferably converge downwardly to the bottom end opening 3 of the hopper. The longitudinal side edges defining the bottom end opening 3 are in FIG. 2 designated 10 and 11. FIG. 2 also illustrates that in normal operation the shaft 4 is adapted to rotate in a clockwise direction as shown by the arrows.

In the area of the first or front longitudinal side edge 10 of the opening 3, there are arranged holding-up means or holding-up tools 12 which, in practice, preferably have the shape of jaws detachably mounted on a frame member 1' which is pivoted to a shaft 13. The individual holding-up jaw 12 is arranged in the space between neighbouring working means 5 on the shaft 4 and substantially fills the space therebetween, such that the individual working means 5 will pass the holding-up means, with their side edges close to the holding-up means. Normally, the holding-up means 12 are positioned with their outer end adjacent the periphery or circumference of the shaft 4, but by means of a preferably double-acting hydraulic cylinder 14, the frame member 1' and thus the holding-up means 12 may be pulled back from the normal position as shown to a position spaced therefrom. Consequently, the holding-up means can be set or adjusted to provide varying degrees of working depending on the varying types of material. Besides, the frame member 1' can, by means of the hydraulic cylinder 14, also be lowered to the position indicated by dash-dots lines, in which position the holding-up means are considerably spaced from the shaft 4 so as to facilitate the maintenance of the holding-up means. In this context, it should be observed that the frame member 1' is spaced from the overlying hopper 2 via a thin dividing gap designated 15.

According to the invention, there are arranged also at the rear longitudinal side edge 11 of the opening 3 holding-up means 16 in the form of jaws or the like which are detachably mounted on the associated frame member 1". In conformity with the first set of holding-up means 12, the holding-up means 16 of this second set are arranged in each of the axially spaced-apart spaces which are formed between neighbouring working means 5 on the shaft 4. This means that the material collected in the lower portion of the hopper 2 cannot get passed the space between the circumference of the shaft 4 and the edge 11, unless the size of the material is less than the width of the individual gap between neighbouring holding-up means 16 and, respectively, the distance between the shaft and the edge 11. In other words, only such small objects can pass between the shaft 4 and the rear edge 11, which otherwise could pass via the spaces between the front holding-up means 12.

The frame member 1" which is pivotable about a shaft 13' is rigidly connected or built together with the overlying hopper 2 and can, together with the hopper, be swung aside, viz. by means of at least one second double-acting hydraulic cylinder 17. During operation, the hopper 2 is secured in its upright position indicated by full lines in FIG. 1, by means of a locking pin 18 which engages into with coinciding holes in a lug 19 on the frame 1 and in arms 20 extending from the infeed hopper 2. After disengagement of the locking pin 18, the hopper 2, which extends over the shaft 4, and both holding-up means 12 and 13 can be swung up in its entirety to the position indicated by dash-dots lines in FIG. 1. In this position the shaft 4 and also the holding-up means 12 and the holding-up means 13 are uncovered an easily accessible.

As shown in FIG. 2, a holding-down clamp 21 is connected with the wall 6 and has, in the embodiment illustrated, the shape of a stamp or punch which is built-in between two separate plates 6',6" which jointly form one longitudinal side wall 6 of the hopper. This stamp reciprocates in the plane of the wall by means of a third double-acting hydraulic cylinder 22 attached to the upper end of the wall plate 6". If an elongate and possibly round object such as a log or the like comes into contact with the working means 5 without being engaged with the holding-up means 12, but instead is rolling on the shaft 4 and the working means thereof, the holding-down clamp 21 can be activated by being first raised to an upper position in which the object or log can roll down to the area of the edge 10, whereupon the holding-down clamp is pressed down against the object by means of the cylinder 22, while providing a firm clamping of the object which can now be worked by the means 5.

Figure 4:
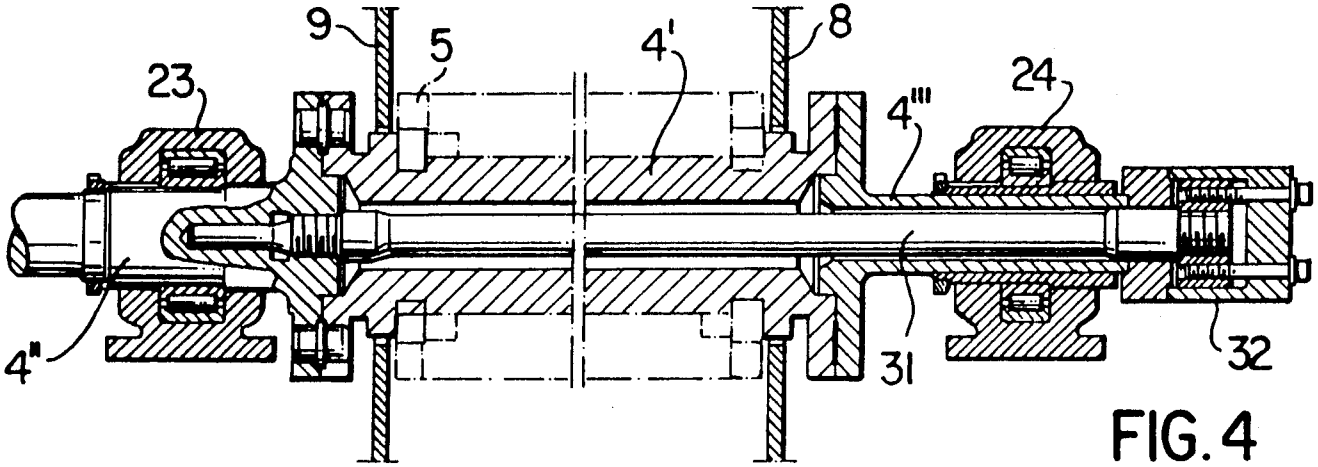
FIGS. 4 and 5 are two longitudinal sections of the shaft in its mounted and dismounted state, respectively.
Figure 5:
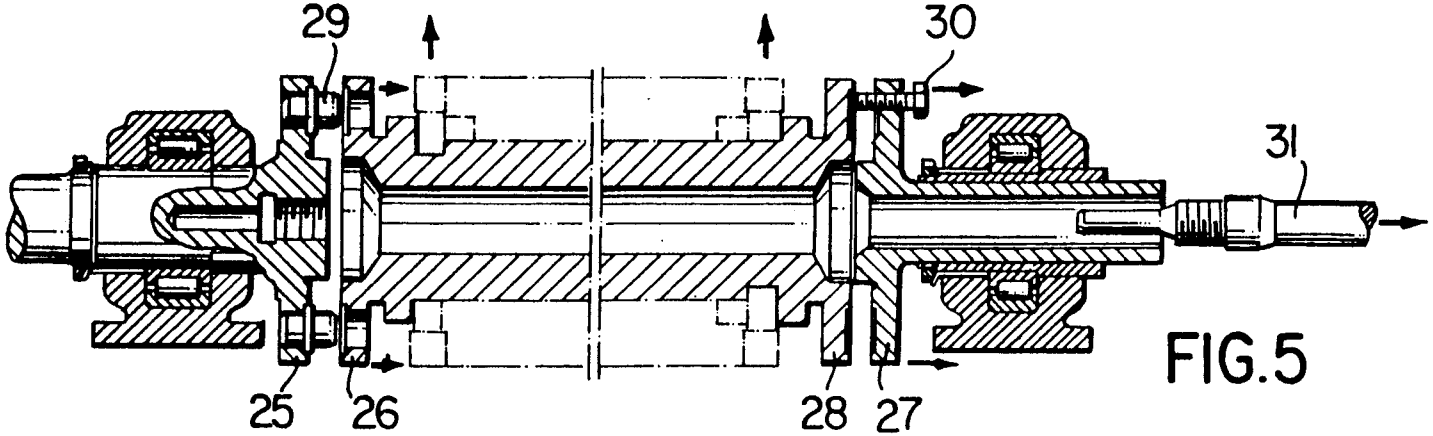

Reference is now made to FIGS. 4 and 5 which illustrate the mounting of the shaft 4 in bearings 23,24 disposed outside the end walls 8,9 of the hopper 2, i.e. outside the opening 3 for the shaft 4. The shaft 4 is divided into three parts, viz. a central part 4' comprising the working means 5, and two separate end parts 4" and 4" which are conveniently mounted in the bearings 23,24. The end part 4" is connected to the central part 4' via a first flange joint comprising the flanges 25,26, while the end part 4" is connected to the central part via a second flange joint comprising two flanges 27,28. The flange joint 25,26 comprises a suitable amount of locking pins 29 which engage into analogous holes in the flanges. The flange joint 27,28 comprises one or more puller screws 30. The three shaft parts are normally held together by a connecting rod 31 whose one end is connected to the end part 4" via a thread joint or the like, while the opposite end comprises a clamping member which in its entirely is designated 32 and by means of which the shaft parts 4' and 4" can be forcibly clamped to the part 4". After the clamping 32 has been released and the connecting rod 31 has been screwed out of the end part 4', the connecting rod can be removed as illustrated in FIG. 5, whereupon the shaft part 4" mounted in the bearing 24 and having a sleeve-shaped hub member can be moved to the right through the bearing 24 from the normal position shown in FIG. 4 to the maintenance position shown in FIG. 5. In the latter position, the central shaft part 4' can be moved away from the flange 25 a distance such that the locking pins 29 are disengaged from the flange 26, at the same time as the flanges 27 and 28 are spaced apart such that the central part 4' is free to be raised. In other words, the part of the shaft which comprises the working means 5 can be moved away from the opening 3, without necessitating dismounting of the bearings 23,24 and the shaft parts 4",4" mounted therein. This possibility in combination with the tilting movement of the hopper 2 and also the pivoting movement of the frame member 1' described above, highly facilitates any form of maintenance of the apparatus. Replacement of both one or more working means 5 and one or more holding-up means 12,16 in the two sets of holding-up means can thus be carried out extremely rapidly, thus resulting in conveniently short down-times.

In operation, the disintegrating apparatus described above functions briefly in the following manner. The objects, e.g. demolition timber, which are to be crushed are let freely into the hopper 2 which, because of its converging shape, concentrates the objects against the rotating shaft 4. The working means 5 on the shaft 4 collect and convey the objects towards the holding-up means 12 against which the individual objects, such as boards, girders, clumps of concrete, e.g are disintegrated by a combined shearing and crushing action, whereupon the treated, relatively fine accept material is allowed to fall down via the passage 33 between the shafts 13,13' and is removed in a optional manner, for example by means of a belt conveyor. If large elongate objects such as logs or the like should tend to roll on top of the shaft 4 without being engaged by the holding-up means 12, the holding-down clamp 21 can be activated in the manner described above. Should it further happen that the working means 5 get stuck, the direction of shaft rotation may be reversed, whereby the rear edges of the respective working means will cooperate with the holding-up means 16 which, according to the invention, are arranged at the rear longitudinal side edge 11 of the opening 3 for the shaft. During such reversed operation, no objects other than very small ones can pass down into the quite narrow passages between neighbouring holding-up means 16, unless they have first been crushed by the working means. In contrast to known apparatus, there is thus no risk that large objects are carried along by the accept material during a temporarily reversed operation.

CONCEIVABLE MODIFICATIONS OF THE INVENTION

Of course, the invention is not limited to the embodiment described above and shown in the drawings. Thus, the shape and design of both the working means 5 on the shaft and the holding-up means 12,16 in the two sets of holding-up means may be varied in many ways. It is also possible to provide not only one longside wall of the hopper 2 with holding-down clamps, for example of the type as exemplified in the drawings, but also the opposite longside wall 7. For example, this wall can be designed with vertical, axially spaced-apart gaps in which there are arranged sector-shaped plates which are attached to a common shaft disposed outside the hopper and which can be pivoted into the interior of the hopper via said gaps. It is further conceivable to secure the hopper 2 in the upright working position by means of a locking mechanism which is shiftable between a locking and an unlocking position by means of the same hydraulic cylinder 14 as used for pivoting the frame member 1'.

We claim:

1. A disintegrating apparatus comprising a feed hopper, adapted to receive material for disintegration;

a frame structure beneath said hopper;

an elongate opening at an upper part of said frame structure and below said hopper, said opening including elongate front and rear edges;

a rotatable shaft mounted in said opening, said shaft having a plurality of axially spaced work members;

first hold-up means at said front edge of said opening, said first hold-up means cooperative with said work members in one direction of rotation of said shaft for disintegration of material;

second hold-up means at said rear edge of said opening, said second hold-up means cooperative with said work members in a reverse direction of rotation of said shaft, to prevent large objects passing between said shaft and said rear edge of said opening and to provide at least a certain degree of disintegration of material; said hopper extending over both said first hold-up means and said second hold-up means; and means for hingedly mounting said hopper on said frame member for pivotal movement of said hopper from over said frame structure and said first and second hold-up means to expose said shaft and said first and second hold-up means, for access thereto.

2. Apparatus as claimed in claim 1, wherein said work members are helically arranged along said shaft.

3. Apparatus as claimed in claim 1, wherein said first and said second hold-up means are detachably mounted on said frame structure.

4. Apparatus as claimed in claim 1, including means mounting said second hold-up means on said hopper.

5. Apparatus as claimed in claim 1, further including mounting means pivotally mounting said first and second hold-up means on said frame structure.

6. Apparatus as claimed in claim 5, including pivotal mounting means for said first hold-up means for movement of said first hold-up means towards and away from said shaft.

7. Apparatus as claimed in claim 1, wherein said shaft comprises:

at least three parts, a central part including said work members and an end part at each end of said central part, said end parts supported in bearings; and connecting means at each end of said central part for releasably connecting said central part with each end part, for removal of the central part without said end parts.

8. Apparatus as claimed in claim 7, wherein said connecting means comprises flanged joints.

9. Apparatus as claimed in claim 8, wherein each flanged joint comprises a pair of opposed flanges, and locking pins releasably locking said flanges together.

* * * * *

UNITED STATES PATENT AND TRADEMARK OFFICE

CERTIFICATE OF CORRECTION

PATENT NO. : 5,102,059

DATED : April 7, 1992

INVENTOR(S) : Jan-Erik Nyberg, et. al.

It is certified that error appears in the above-indentified patent and that said Letters Patent is hereby corrected as shown below:

On the Title page, item [54], the title of the patent has been corrected from "Disintergrating Apparatus" to --Disintegrating Apparatus--.

Signed and Sealed this

Fifteenth Day of June, 1993

Attest:

Michael K. Kirk

MICHAEL K. KIRK

Attesting Officer

Acting Commissioner of Patents and Trademarks